US006356016B1

(12) United States Patent
Suijker et al.

(10) Patent No.: US 6,356,016 B1
(45) Date of Patent: Mar. 12, 2002

(54) HIGH-PRESSURE METAL-HALIDE LAMP THAT INCLUDES A CERAMIC-CARRIER OXYGEN DISPENSER

(75) Inventors: Joseph L. G. Suijker, Eindhoven (NL); Marinus C. Raas, Turnhout (BE)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/286,120

(22) Filed: Apr. 2, 1999

(30) Foreign Application Priority Data

Apr. 8, 1998 (EP) ..... 98201118

(51) Int. Cl.[7] ..... H01J 17/26; H01J 61/28; H01J 17/24; H01J 17/20; H01K 1/50

(52) U.S. Cl. ..... 313/563; 313/550; 313/562; 313/566; 313/579; 313/637

(58) Field of Search ..... 313/491–493, 313/631–632, 634–635, 636–642, 545–547, 550, 551, 563–564, 567, 573, 574, 579, 562

(56) References Cited

U.S. PATENT DOCUMENTS

| | | | | |
|---|---|---|---|---|
| 3,521,110 | A | 7/1970 | Johnson | 313/223 |
| 3,720,855 | A | 3/1973 | Gardner et al. | 313/229 |
| 4,620,129 | A | 10/1986 | Luthra | 313/630 |
| 4,672,267 | A | 6/1987 | Lapatovich et al. | 313/571 |
| 4,918,352 | A | 4/1990 | Hess et al. | 313/25 |
| 5,424,609 | A | 6/1995 | Geven et al. | 313/623 |
| 5,461,281 | A | 10/1995 | Fromm et al. | 313/556 |
| 5,986,405 | A1 * | 1/2001 | De Maagt et al. | 313/637 |
| 6,169,361 | B1 * | 1/2001 | Boffito et al. | 313/564 |

FOREIGN PATENT DOCUMENTS

| | | | |
|---|---|---|---|
| EP | 0587238 | 9/1993 | H01J/61/36 |

* cited by examiner

*Primary Examiner*—Vip Patel
*Assistant Examiner*—Mack Haynes
(74) *Attorney, Agent, or Firm*—Dicran Halajian

(57) ABSTRACT

The invention relates to a high-pressure metal-halide lamp comprising a discharge vessel with an ionizable filling containing Hg, a halide and a rare gas, which vessel includes electrodes with a rod containing substantially W. The lamp, when in operation, maintains a W-halide cycle in the discharge vessel. According to the invention, the discharge vessel contains an oxygen dispenser.

9 Claims, 2 Drawing Sheets

HIGH-PRESSURE METAL-HALIDE LAMP THAT INCLUDES A CERAMIC-CARRIER OXYGEN DISPENSER

BACKGROUND OF THE INVENTION

The invention relates to a high-pressure metal-halide lamp provided with a discharge vessel with an ionizable filling containing one or more metals among which Hg, a halide and a rare gas, which vessel comprises electrodes with a rod containing substantially W, the lamp, when in operation, maintaining a W-halide cycle in the discharge vessel.

A lamp of the type defined in the opening paragraph is known from U.S. Pat. No. 3,521,110. The known lamp, used as a light source of white light having a high luminous efficacy, has a discharge vessel with a wall of quartz glass. Other suitable wall material is ceramic. A ceramic wall is here understood to mean a refractive material such as monocrystalline metal oxide (for example, sapphire), polycrystalline metal oxide (for example, polycrystalline sintered aluminum oxide; yttrium aluminum garnet or yttrium oxide) and polycrystalline non-oxidic material (for example, aluminum nitride). The occurrence of the W halide cycle is the cause for an extension of the useful life of the lamp, because W evaporated from the electrode does not deposit on the entire surface of the wall of the discharge vessel. A condition for the occurrence of the W-halide cycle is the presence in the discharge vessel of a small amount of free oxygen when the lamp is in operation. A free oxygen source is generally contaminations occurring during the manufacture of the lamp and released therefrom when the lamp is in the operating state. It has also been established that oxygen is released from the wall of the discharge vessel under the influence of reactions to filling components of the discharge vessel.

A disadvantage of the known lamp is that the amount of oxygen available in the discharge vessel in the operating state of the lamp is uncontrollable. In the case of too small a concentration, it will hardly be possible to maintain the W halide cycle sufficiently during the operation of the lamp. In the case of too large a concentration, there will be, inter alia, corrosion of the W-rod electrode. In view of an accuracy of manufacture required for a proper operation of the lamp, the chance of too small a concentration of oxygen is ever more becoming a problem.

It has been proposed oxygen to dose in the filling, for example, in the form of oxyhalides such as, for example, niobium oxytrihalide (U.S. Pat. No. 4,672,267) or in the form of HgO (U.S. Pat. No. 3,720,855). A drawback of such dosings is that lamps manufactured thus burn unstably even when molecular stabilizers are used. A further drawback is that HgO is poisonous. A serious drawback of the use of Nb is that it has the tendency of dissolving in W and thus lowering the melting point of the W electrode, as a result of which a stronger evaporation of W will occur. The presence of free oxygen in a non-ignited lamp has a disadvantageous influence on the ignition of the lamp and is thus to be avoided.

SUMMARY OF THE INVENTION

It is an object of the invention to combat the described disadvantageous influence. For this purpose, the discharge vessel contains an oxygen dispenser.

The lamp according to the invention is advantageous in that oxygen is fed to the discharge vessel in a controlled manner during the operation of the lamp. An additional advantage is that dosaging during the life of the lamp becomes possible. In a first advantageous embodiment of the lamp according to the invention, the oxygen dispenser contains $WO_2$. In a further advantageous embodiment of the lamp according to the invention, the oxygen dispenser contains CaO. Both $WO_2$ and CaO have the advantage that, when $O_2$ is supplied, elements are released which are commonly applied to discharge lamps, for example, as filling components. Preferably, an oxygen dispenser containing CaO is used in a lamp according to the invention with a ceramic discharge vessel. A surprising advantage of this lamp is that the Ca appears not only to maintain the W halide cycle, but also to deliver a spectral contribution both to red and in blue. Thus, a lamp can be manufactured which emits light that has a color temperature $T_c$ of up to 3500 K and a value for the general color rendition index $R_a$ of over 80.

These and other aspects of the invention will be apparent from and elucidated with reference to the embodiments described hereinafter.

DETAILED DESCRIPTION OF THE PREFERRED EMBODIMENTS

Figure 1:
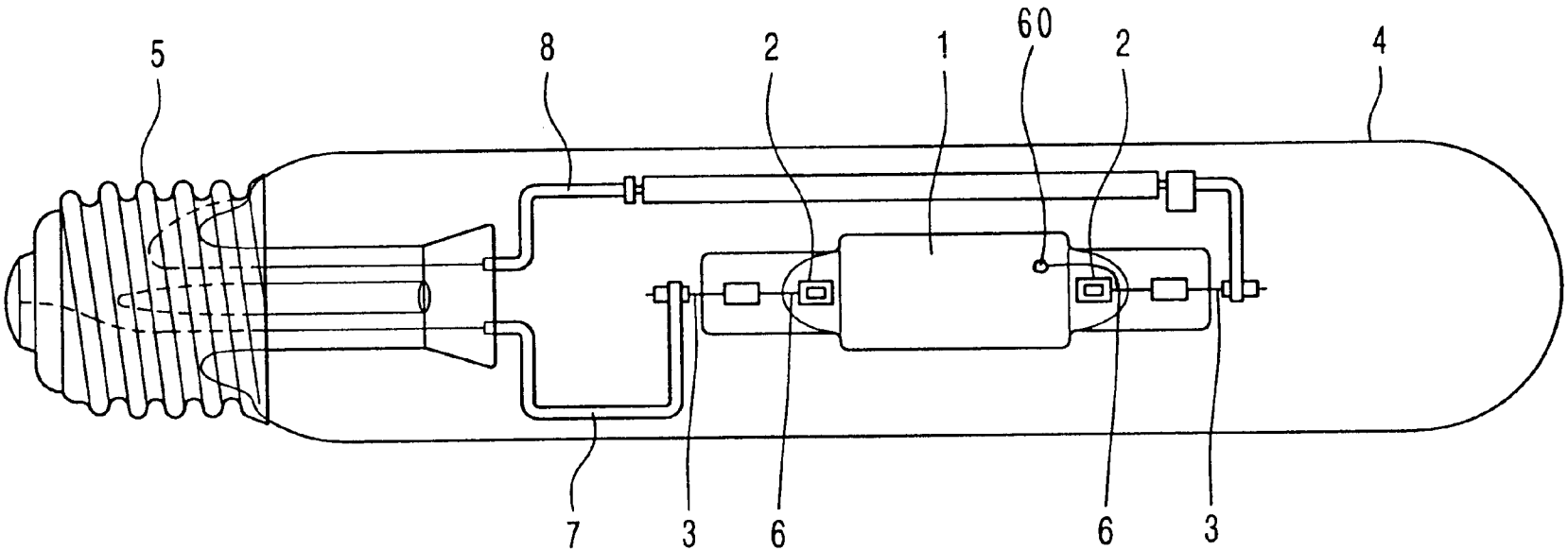
FIG. 1 shows a lamp according to the invention.

The high-pressure metal halide discharge lamp shown in FIG. 1 has a gastight, light-transmissive discharge vessel 1, of quartz glass in the Figure. The discharge vessel has an ionizable filling of rare gas and metal halide. The filling of the lamp shown comprises mercury, iodides of sodium, indium, thallium and a rare gas consisting of a mixture of 99.8% neon by volume and 0.2% krypton by volume with a filling pressure of 50 mbar. The filling also has an oxygen dispenser 60 containing $WO_2$, for example, in the form of a ceramic $WO_2$-impregnated carrier. Electrodes 2 in the discharge vessel each have a rod 6 substantially containing W, which rods are connected to conductors 3, of molybdenum in the Figure, which lead out through the discharge vessel to the exterior and are connected via electrical contacts 7 and 8 to a lamp base 5. The lamp shown has a hardglass outer bulb 4 carrying the lamp base 5. The lamp shown has a power consumption of 400 W.

Figure 2:
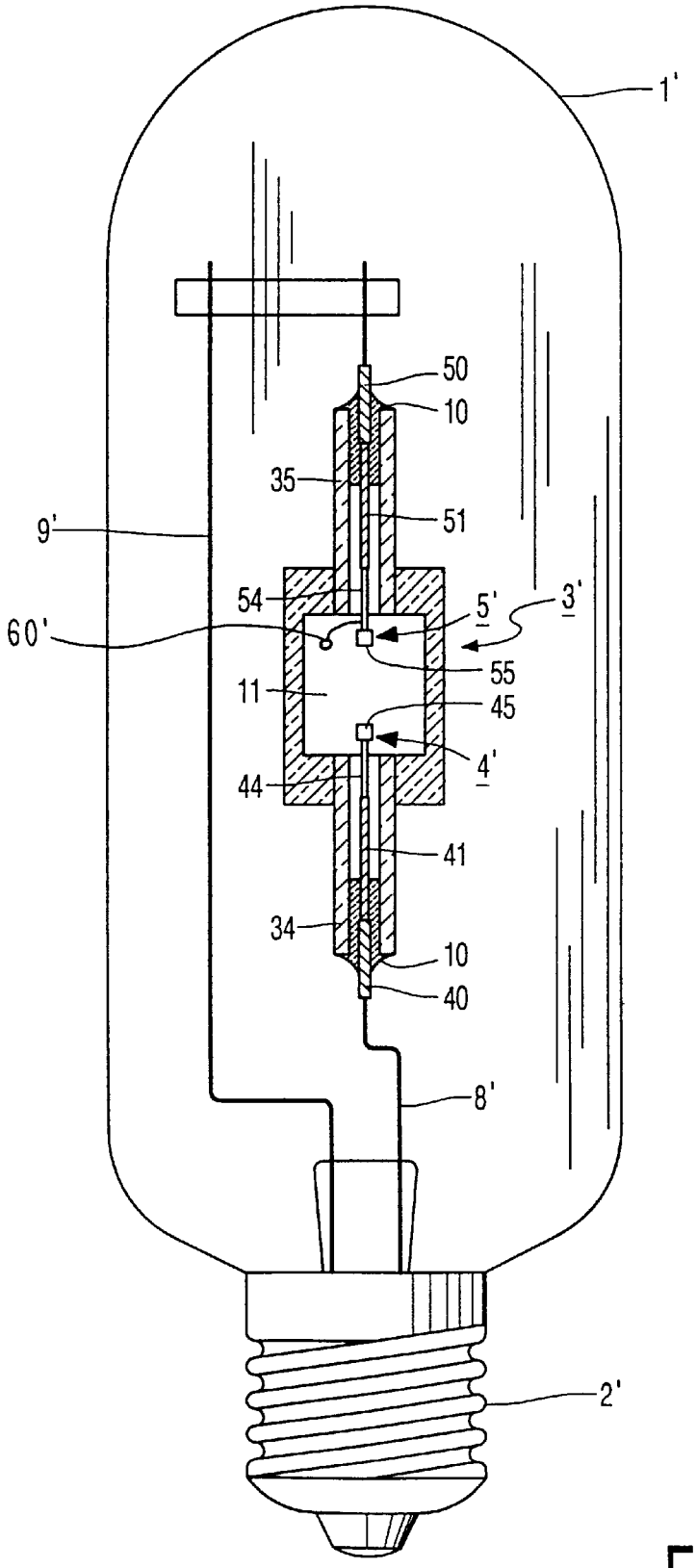
FIG. 2 shows a further lamp according to the invention.

In the case of the lamp shown in FIG. 2, a metal halide lamp is represented with a cut-away view of a ceramic-wall discharge vessel 3', not shown to scale, enclosing a discharge space 11 which discharge space contains an ionizable filling which in the case shown contains not only Hg, but also Na- and Tl halide. The filling also contains an oxygen dispenser 60' containing CaO, for example, in the form of a ceramic CaO-impregnated carrier. Two electrodes 4', 5' having electrode rods 44, 54 and tops 45, 55 are arranged in the discharge vessel and contain substantially W. The discharge vessel is closed on one side by a ceramic protruding plug 34, 35 which closely surrounds with clearance a lead-in 40, 41; 50, 51 respectively, to the electrode 4', 5' arranged in the discharge vessel and is connected thereto in a gastight manner by means of a melting-ceramic joint 10 adjacent an end turned away from the discharge vessel. The construction of the discharge vessel as shown in the Figure is known per se, for example, from EP-0 587 238. The discharge vessel is surrounded by an outer bulb 1' on one end having a lamp base 2'. Between electrodes 4', 5' there is a discharge when the lamp is in operation. Electrode 4' is connected via a conductor 8' to a first electrical contact which forms part of the lamp base 2'. Electrode 5' is connected via a conductor 9' to a second electrical contact which forms part of the lamp base 2'.

In a practical embodiment of a lamp as described in FIG. 2, the nominal power of the lamp is 70 W and the lamp has a nominal lamp voltage of 90 V. The translucent wall of the discharge vessel has a thickness of 0.8 mm. The inner diameter of the discharge vessel is 6.85 mm, the distance between the electrode tops 7 mm. The ionizable filling of the lamp contains in addition to 4.8 mg Hg, 7 mg (Na+Tl+Ca) jodide having a weight percentage composition of 28.8; 10.7 and 60.5. The discharge vessel also contains Ar as a start enhancer with a filling pressure of 300 mbar. During the operation of the lamp, $T_{kp}$ is 1210 K. The lamp emits light with a specific luminous flux of 901 m/W for 100 hours. The color temperature $T_c$ of the emitted light is 3150 K. The general color rendering index $R_a$ is 84.

What is claimed is:

1. A high-pressure metal-halide lamp, comprising a discharge vessel and electrodes; said discharge vessel including an ionizable filling comprising Hg, a halide and a rare gas, wherein discharge vessel encloses said electrodes with a rod consisting essentially of W, the lamp, when in operation, maintaining a W-halide cycle in the discharge vessel, wherein the discharge vessel comprises an oxygen dispenser having a ceramic carrier.

2. A lamp as claimed in claim 1, wherein the oxygen dispenser contains $WO_2$.

3. A lamp as claimed in claim 1, wherein the oxygen dispenser contains CaO.

4. A lamp as claimed in claim 3, wherein the discharge vessel is a ceramic discharge vessel.

5. A lamp as claimed in claim 1, wherein the ceramic carrier is impregnated with $WO_2$.

6. A lamp as claimed in claim 1, wherein the ceramic carrier is impregnated with CaO.

7. A lamp as claimed in claim 1, wherein a color temperature of said lamp is up to 3500 K and a color rendition index is greater than 80.

8. A lamp as claimed in claim 1, wherein a color temperature of said lamp is up to 3500 K.

9. A lamp as claimed in claim 1, wherein a color rendition index of said lamp is greater than 80.

* * * * *